United States Patent [19]

Brand

[11] 4,015,827

[45] Apr. 5, 1977

[54] SUPPORT STANCHION

[76] Inventor: Harold E. Brand, 11039 Fenway St., Sun Valley, Calif. 91352

[22] Filed: Nov. 21, 1975

[21] Appl. No.: 634,071

[52] U.S. Cl. ..... 256/59; 403/379

[51] Int. Cl.[2] ..... E84H 17/14

[58] Field of Search ..... 256/59, 65, 21, 24, 256/DIG. 6; 403/379, 378; 248/226 B, 226 C

[56] References Cited

UNITED STATES PATENTS

| | | | |
|---|---|---|---|
| 2,568,827 | 9/1951 | Schallock | 403/378 X |
| 3,788,608 | 1/1974 | Raymond et al. | 52/183 X |
| 3,901,481 | 8/1975 | Probst | 256/59 |
| 3,920,221 | 11/1975 | Berry et al. | 256/59 |

*Primary Examiner*—Wayne L. Shedd
*Attorney, Agent, or Firm*—Roger A. Marrs

[57] ABSTRACT

A stanchion is disclosed herein for supporting a life line around the perimeter of an elevated area such as a building roof. The stanchion includes a base secured to a building support and includes a tubular receptacle carried on the base and supported thereon by an angular gusset. The tubular receptacle insertably receives one end of an elongated rod or tube which projects upwardly and terminates in a free end. Midway along the length of the upright tube and the support tube, a plurality of eyelets are provided through which the life line may be trained. Removable fastening means as well as indexing devices are employed for detachably securing the upright tube or rod to the support tube.

1 Claim, 7 Drawing Figures

Fig. 1
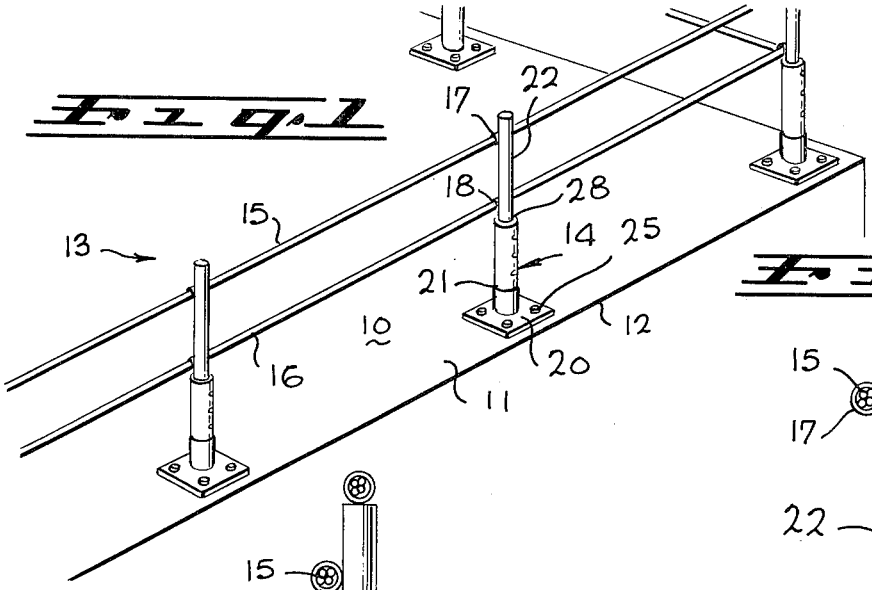
Fig. 2
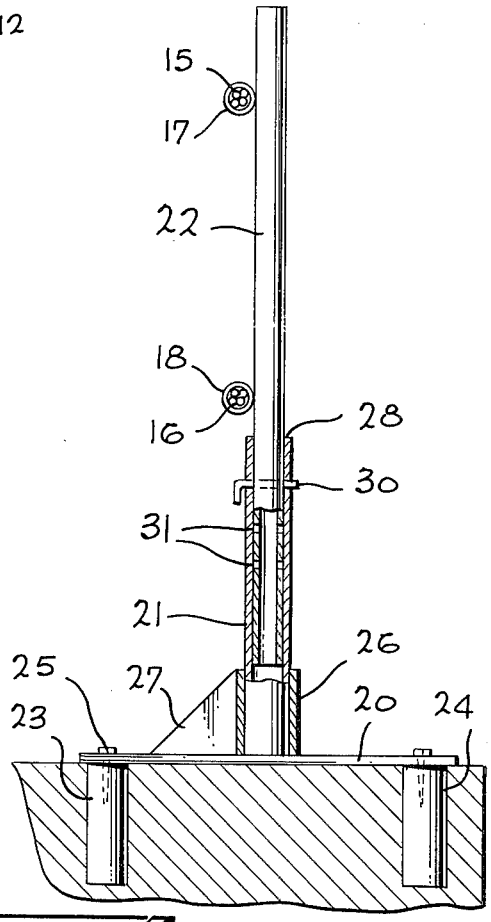
Fig. 3
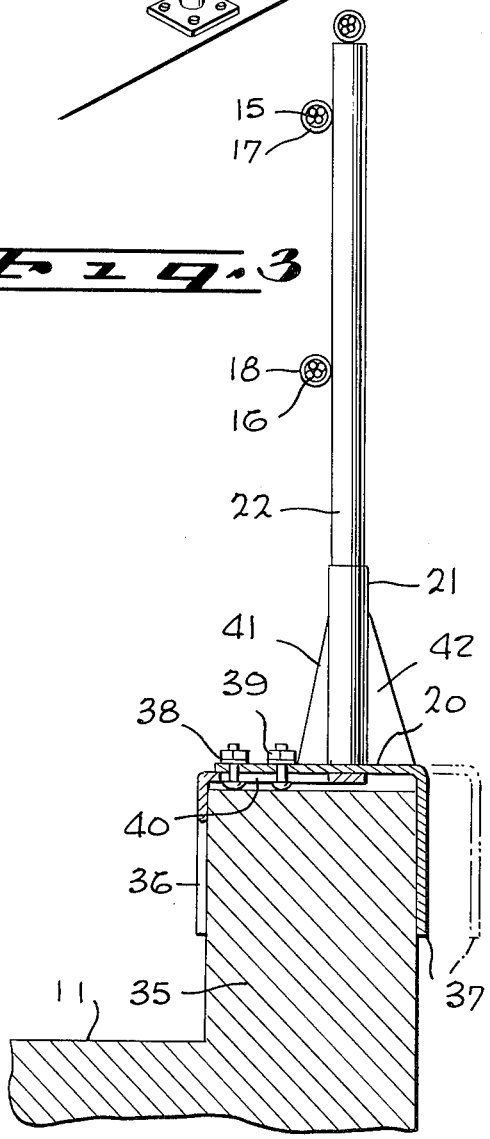
Fig. 4
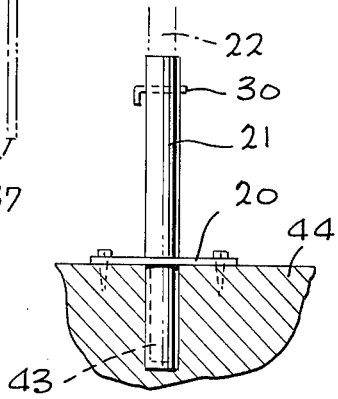
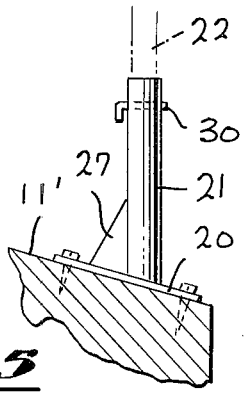
Fig. 5

SUPPORT STANCHION

BACKGROUND OF THE INVENTION

1. Field of the Invention

This invention relates to removable stanchions for supporting life lines and more particularly to a novel stanchion adapted to terminate mountings on a variety of building structures and which includes a detachable portion adaptable for removal when not required.

2. Brief Description of the Prior Art

In the past, stanchions have been combined so as to cooperatively support a life line or a pair of life lines which are trained around the perimeter of a predetermined area. Such an area may be the gunwale of a boat or the edge of a building on a roof. In the latter instance, the life line is intended for temporary use while workmen are in the process of construction or repair activities on the roof. Once the construction or repairs have taken place, the life line is removed. However, upon the need for workment to go along at subsequent times, a new life line system must be established. Installation at this time is extremely hazardous to personnel, time consuming and it may structurally damage the building fixtures upon which the life line system is being reestablished.

Such prior art systems can be found in disclosures of U.S. Pat. Nos. 2,379,572 and 3,268,193. Although the prior stanchions and line supports are useful for their intended purposes, they do not reflect a detachable or removable construction and do not provide means for reusable supports in the event establishment of a safety line system is needed after initial installation.

Therefore, a long standing need is present to provide a stanchion for life line support that may be readily installed and removed leaving a base portion secured to the building construction for future reestablishment for a life line system.

SUMMARY OF THE INVENTION

Accordingly, the above problems and difficulties are obviated by the present invention which provides a novel stanchion and life line system wherein each stanchion includes an anchor base or support which is form fitting to the structure on which it is attached. The anchor or base support further includes a tube section or portion which is fixedly carried on the anchor plate or base and is supported thereon by means of an angular gusset. The tubular portion on the support insertably receives one end of an elongated post, rod or tube which extends upwardly and includes a plurality of eyelets intended to slidably receive a length of life line. Means are provided for releasably or detachably coupling a selected end of the post, rod or tube to the tubular support base or anchor and other means are provided for indexing the elongated rod, post or tube to the base so that the eyelets project from a selected side of the base. Such an arrangement would provide a means for cooperating with life line extension from adjacent ones of other stanchions arranged about the perimeter of an area to be protected.

Therefore, it is among the primary objects of the present invention to provide a novel life line stanchion system wherein installation may be initially reformed followed by subsequent removal of the stanchion whereby the base would remain for future reestablishment of the system.

Another object of the present invention is to provide a novel life line stanchion having a permanently secured base portion fastened to a building structure and a removable portion which supports a life line system.

Another object of the present invention is to provide novel life line system wherein each stanchion includes an anchor support form fitted to a variety of structures.

A further object of the present invention is to provide a novel life line stanchion having a fixed portion for anchoring the stanchion on to a roof of a building and having a removable portion carried thereon by means of indexing and releasable fastening devices so that the base or anchor portion need not be removed when the need for life line support is no longer present and the removable portion has been disassembled.

Still a further object of the present invention is to provide a novel life line stanchion having a fixed portion and a removable portion secured together by releasable means which is inexpensive to manufacture and which is easily maintained and installed.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view of the novel life line stanchion system incorporating a plurality of stanchions for cooperatively supporting a pair of life lines;

FIG. 2 is an enlarged longitudinal cross sectional view of a novel stanchion used in the system of the present invention;

FIG. 3 is a transverse cross sectional view of a modified base for the novel stanchion so that the stanchion may be supported on a roof wall;

FIG. 4 is a side elevational view of another system for securing the base on to a roof;

FIG. 5 is another modification of the anchor or support base illustrated for installation on an inclined or angular roof surface.

DESCRIPTION OF THE PREFERRED EMBODIMENT

Figure 6:
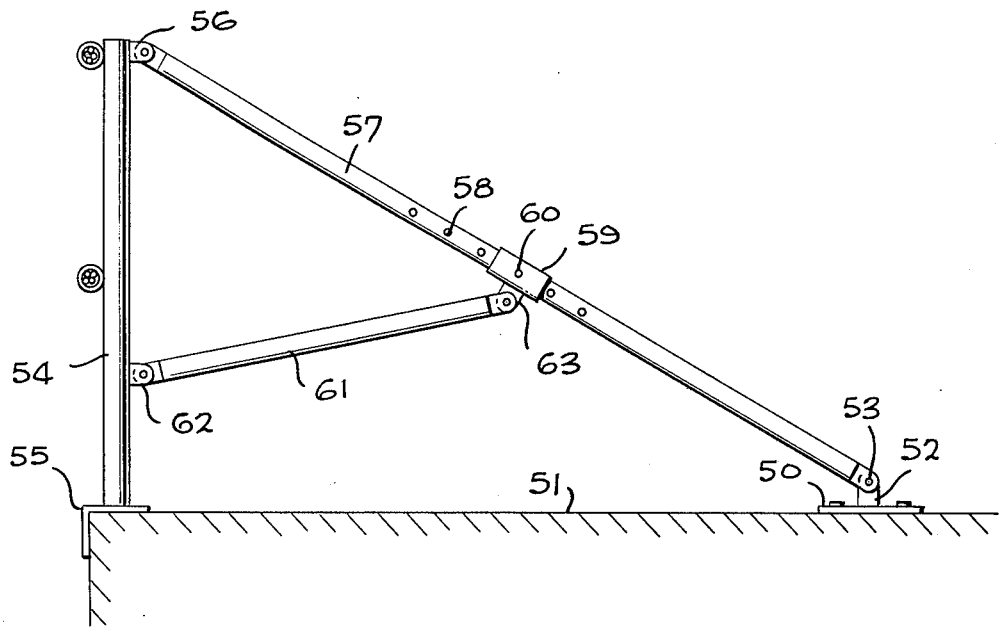
FIGS. 6 and 7 are other embodiments.

Referring to FIG. 1, the roof of a building is illustrated and represented by numeral 10 which includes a roof 11 having a edge 12 joining with the sides of the building to define the outer limits of the roof. In order to protect personnel, such as workmen and others, while engaging in construction or repair of the roof, a life line support system is incorporated on the roof and is shown in the general direction of arrow 13. The life line support system includes a plurality of upright stanchions, such as stanchion 14, which cooperate with adjacent stanchions for supporting a pair of life lines 15 and 16 which are trained through eyelets 17 and 18 on each of the stanchions. A feature of the present invention resides in the fact that each of the stanchions includes a support base 20 which is fixedly secured onto the surface of the base 11, a tubular portion 21 which is attached to the base or anchor 20 and serve to support a removable portion 22. The eyelets 17 and 18 are carried on a removable portion 22. By this means, the life line system may be erected while workmen are performing the repairs or construction on a roof and when this work has been completed, the removable portions 22 may be separated from the fixed portion. Therefore, the fixed portion can remain on a roof ready for installation of the removable portion and establishment of a life line system.

It can be seen that the anchor or base 20 is rigidly attached to support members 23 and 24 of the roof construction by means of bolts or screws 25. The anchor or base 20 includes a tubular portion 26 which is made rigid by means of a gusset plate 27. Tube 21 may be a part of the tube 26 and in any event, upwardly projects from the support base 20 so as to terminate at an open free end 28. A selected end of removable tube or rod 22 is inserably received through the open end 28 and removable securement is effected by means of a detachable fastening means such as a pin 30 which passes through aligned holes provided in tubes 21 and 22 respectively. Unused holes in tubes 22 are illustrated by numeral 31. By this means, the height of the stanchion above the surface of the roof may be adjusted as desired.

Referring now in general to the embodiment shown in FIG. 3, modification of the anchor plate is made so that the stanchion may be installed on the edge of a wall 35 carried on the roof 11. The base 20 is modified so as to provide downwardly extending legs 36 and 37 which are separated by sufficient space to accommodate the thickness of the wall 35. Inasmuch as the thickness of walls sometimes is different from one building to another, an adjustment means is provided wherein the plate 20 is divided into a pair of L-shaped sections which are joined together by adjustment screws 38 and 39. It can be seen that the L-shaped plate 36 may be moved with respect to the L-shaped plate 37 since the fasteners 38 and 39 pass through a slot through one end of the plate 36 as indicated by numeral 40. Once proper separation has been established, the screws or bolts may be tightened so there is no further relative movement between the two L-shaped parts. In a similar fashion to the previously described embodiment, gusset plates 41 and 42 are provided for added strength and the upright post or rod 22 is removable from the support tube 21.

With respect to FIG. 4, a modification is shown wherein the anchor support 20 includes a downwardly depending tube 43 which is buried or imbedded within a beam 44 of the roof structure. The tube 43 includes a receptacle into which the upright post or rod 22 is seated. The receptacle 43 is a downwardly depending extension from the upper tube 21 which removably receives the selected end of an upright tube or rod 22. A removable pin 30 is employed for detachably securing the tubes 21 and 22 together.

In FIG. 5, another modification is illustrated so that the base plate 20 may be carried on a slanting or inclined roof 11'. In this latter instance, the plate 20 angularly disposed with respect to the elongated center line or longitudinal axis of the tube 21.

Referring to FIGS. 5 and 6, additional versions or modifications of the present invention are illustrated wherein a portable life line stanchion is shown that does not require as substantial and anchoring fixture as previously described. For example, the stanchion shown in FIG. 6 includes a base anchor or plate 50 which is fixedly secured to the surface of the roof 51 by any suitable means such as screws, bolts or the like. The remainder of the stanchion is detachably connected or releasably secured to a lug 52 carried on the plate 50 by means of a wing nut attachment 53. The stanchion itself includes a post portion 52 which carries an L-shaped member 55 on one end and a lug 56 on its opposite end. Between the lug 52 and the lug 56 and extendable or expandable brace 57 is attached at its opposite end by pivot means. The extendable member 57 includes a plurality of holes or apertures, such as aperture 58, which may be readily aligned with a pin insertably carried on a slide member 59. The pin is identified by numeral 60 and may be slid or inserted through a hole in the slider 59 when it is in registry with a selected one of the holes in the member 57. A brace 61 is pivotally connected at its opposite ends between an intermediate lug 62 carried on the post 54 midway between its opposite ends and a lug 63 carried on the slider 59. By this construction, the height of the post may be accommodated depending upon the distance between the corner of the roof and the placement of the blade 50. Also, the L-shaped member 55 form fits about the corner or the edge of the roof 50.

Figure 7:
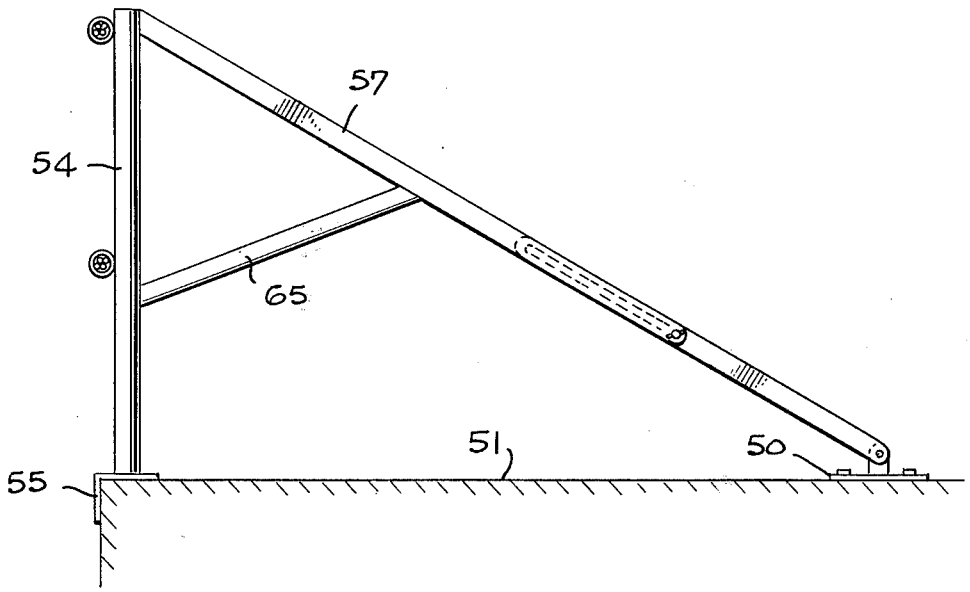

Referring now in detail to FIG. 7, it is noted that the stanchion apparatus is substantially similar to that shown in FIG. 6 with the exception that the brace 65 is fixed between the post 54 and expandable member 57. In this instance, member 57 is composed of a pair of links having a slot formed in one with a wing nut tying the two together. Therefore, when it is desired to extend the length of member 57, the pair of links are pulled apart when the wing nut is released and when the stanchion post 54 is properly seated on the roof, the wing nut can be tightened to prevent slippage between the two links. Suitable eyelets and life lines may be carried on the exterior surface of the respective posts.

In the modification shown in FIGS. 5 and 6, when it is desired to remove the stanchion, all that is necessary is removal of the wing nut 53 so that the entire post and expandable member 57, including brace 55, can be removed.

Accordingly, it can be seen that the novel stanchion system of the present invention provides a plurality of stanchions wherein each stanchion has a removable portion which may be detached from a base portion when it is desired to take the life line system away from the installed installation. The anchor portion is permanently mounted to the roof and is ready for use at a subsequent time to receive the removed portion to re-establish the life line system. A plurality of different shaped base plates are provided so that a variety of different shaped roof supports may be accommodated. The anchor support may be placed on the edges of walls, slopes or inclined roofs, flat roofs or carried into buried receptacles.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A life line support system comprising the combination of:

a plurality of stanchions wherein each stanchion consists of a stationary portion and a removable portion;

said stationary portion being fixedly attached to a roof of a building construction on the perimeter of an area to be protected;

said stationary portion having an anchor base and a tubular portion secured thereto and a gusset plate interconnecting said tubular portion and said anchor plate;

said removable portion constituting an elongated post having a selected end insertably received into said tubular portion;

fastener means detachably coupled to said tubular portion for retaining said elongated post in position thereon;

a plurality of eyelets carried on said elongated post for slidably carrying life lines therethrough;

said fastener means includes a pin insertably carried within aligned holes provided in said tubular portion and said removable portion;

index means for aligning said removable portion with said tubular portion;

an expandable plate means as a part of said tubular portion for mounting on the roof;

said plate means is composed of a pair of L-shaped members movably secured together in sliding and in releasable relationship by bolts; and a selected one of said plate L-shaped members fixedly carrying said gusset plate and said tubular portion so as to constitute a structural unit.

* * * * *